US006676545B1

(12) United States Patent
Beazley

(10) Patent No.: US 6,676,545 B1
(45) Date of Patent: Jan. 13, 2004

(54) BALL REBOUND WALL APPARATUS FOR A SWIMMING POOL

(76) Inventor: William W. Beazley, 12691 Mountain Crest, Los Angeles, CA (US) 90049

( * ) Notice: Subject to any disclaimer, the term of this patent is extended or adjusted under 35 U.S.C. 154(b) by 49 days.

(21) Appl. No.: 10/119,617

(22) Filed: Apr. 9, 2002

(51) Int. Cl.[7] ..... A63B 67/00
(52) U.S. Cl. ..... 473/466; 473/422; 273/350
(58) Field of Search ..... 473/466, 422; 273/336, 350; 114/230.26

(56) References Cited

U.S. PATENT DOCUMENTS

| | | | | |
|---|---|---|---|---|
| 2,818,254 A | | 12/1957 | Dunn | |
| 4,220,337 A | | 9/1980 | Moore | |
| 4,729,331 A | * | 3/1988 | Eggleston | 114/230.26 |
| 5,000,461 A | | 3/1991 | Borazjani | |
| 5,816,954 A | * | 10/1998 | Zheng | 473/471 |
| 6,113,506 A | | 9/2000 | Nielsen | |
| 6,220,975 B1 | | 4/2001 | Beazley | |

* cited by examiner

*Primary Examiner*—Paul T. Sewell
*Assistant Examiner*—M. Chambers
(74) *Attorney, Agent, or Firm*—Jack C. Munro

(57) ABSTRACT

A ball rebound wall apparatus for a swimming pool which uses a substantially planar panel mounted on a pontoon assembly. The pontoon assembly is to be floatingly located within the swimming pool. A ballast is to be placed on the pool decking with a pontoon assembly to be tied to the ballast in order to locate the pontoon assembly in a set position and maintain the pontoon assembly in a set position. The pontoon assembly includes a groove. The ball rebound wall is to be mounted within the groove to be supported on the pontoon assembly. The pontoon assembly can be varied in its flotation ability by increasing or decreasing flotation. The rebound wall is to be tilted to assume an inclined position so that upon a ball striking the rebound wall, the ball is rebounded in an upward direction away from the surface of the water of the swimming pool. The ball rebound wall apparatus is to be readily removable and disassembled when not in use.

10 Claims, 3 Drawing Sheets

BALL REBOUND WALL APPARATUS FOR A SWIMMING POOL

BACKGROUND OF THE INVENTION

1. Field of the Invention

The field of this invention is directed to a ball rebound wall apparatus in the form of a ball rebound panel which comprises a backboard. The panel is to be mounted in conjunction with a swimming pool with the panel to be utilized by humans in the practicing of a game that is to be played within the swimming pool.

2. Description of Related Art

It has long been known to play ball games in conjunction with swimming pools. One form of game is called water polo. Water polo uses a ball that is about ten inches in diameter with the ball to be thrown at a goal which is defined as a small enclosed area which has a net. It is the intention of the player to throw the water polo ball into the goal with the water polo ball to be stopped within the confines of the goal by the net.

When practicing water polo, it is desirable that when a player throws the ball toward a goal that the ball will merely rebound back toward the player. To accomplish this rebound, there is to be used a rebound wall in the form of a planar panel. This rebounding of the ball back toward the player eliminates the player having to swim into the area of the goal and pick up the ball and then swim back to an area to again throw the ball toward the goal. Therefore, the player should be able to throw the ball toward the rebound wall a substantially greater number of times in a given period of time as opposed to if the player was throwing the ball into a net type goal. The rebound wall may include a target to which the player is to aim the ball. Also, the rebound wall could include a hole with it being the intention for the ball to be thrown within that hole. However, in this situation, the ball is not rebounded to the player.

SUMMARY OF THE INVENTION

A rebound wall apparatus for a swimming pool which comprises a pontoon assembly to be placed within the swimming pool with the pontoon assembly to float on the surface of the swimming pool. A ball rebound panel is to be supported on the pontoon assembly. A ballast is to be placed on the swimming pool decking with the pontoon assembly to be tied to the ballast in order to essentially fix in position the pontoon assembly within the swimming pool.

A further embodiment of the present invention is where the first basic embodiment is modified by the pontoon assembly comprising a pair of spaced-apart pontoons.

A further embodiment of the present invention is where the first basic embodiment is modified by the bottom surface of the pontoon assembly including an enlarged recess.

A further embodiment of the present invention is where the enlarged recess is to include a separate float.

A further embodiment of the present invention is where the float is to comprise a foam block with there being available a plurality of different sizes of foam blocks in order to be able to adjust the amount of flotation of the pontoon assembly within the swimming pool.

A further embodiment of the present invention is where the first basic embodiment is modified by there being formed on the pontoon assembly a groove with the ball rebound wall panel to be mounted Within this groove.

A further embodiment of the present invention is where the groove is defined as being open ended.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
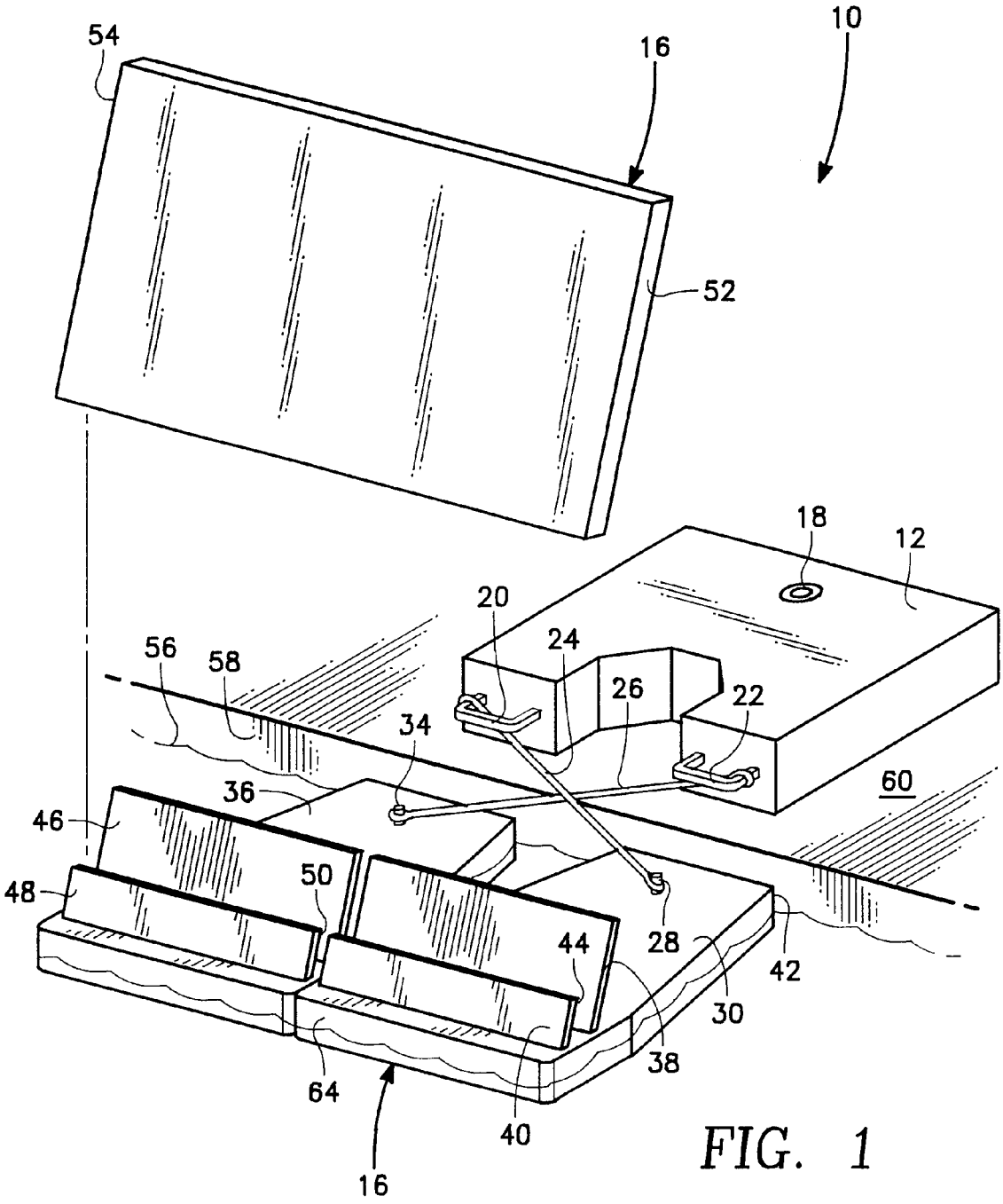
FIG. 1 is a front isometric view of the ball rebound wall apparatus of the present invention showing such mounted in conjunction with a conventional swimming pool.
Figure 2:
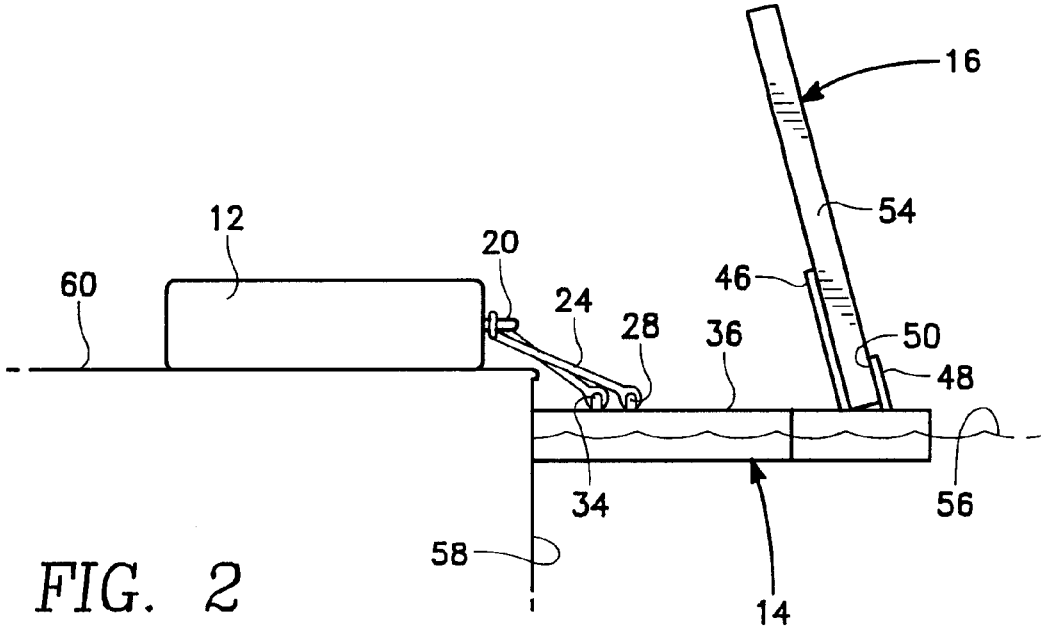
FIG. 2 is a side view of the ball rebound wall apparatus of the present invention again showing such mounted in conjunction with a conventional swimming pool.
Figure 3:
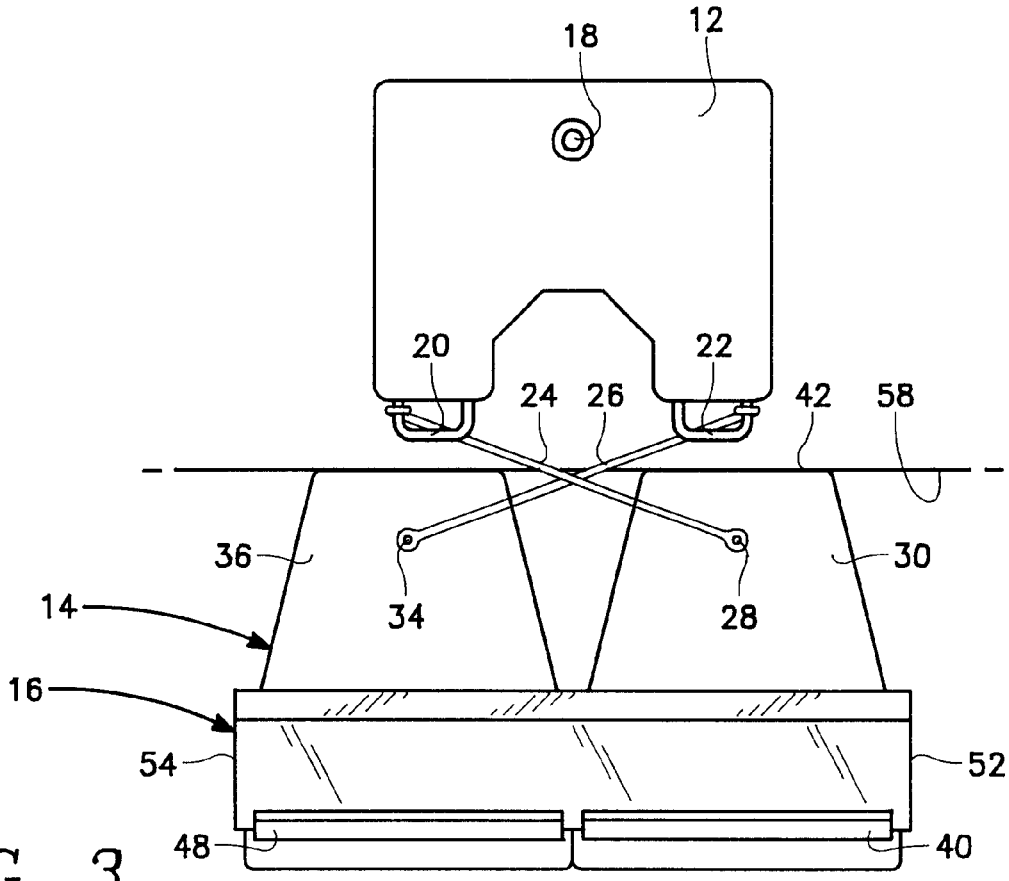
FIG. 3 is a top plan view of the ball rebound wall apparatus of the present invention again showing such mounted in conjunction with a conventional swimming pool.
Figure 4:
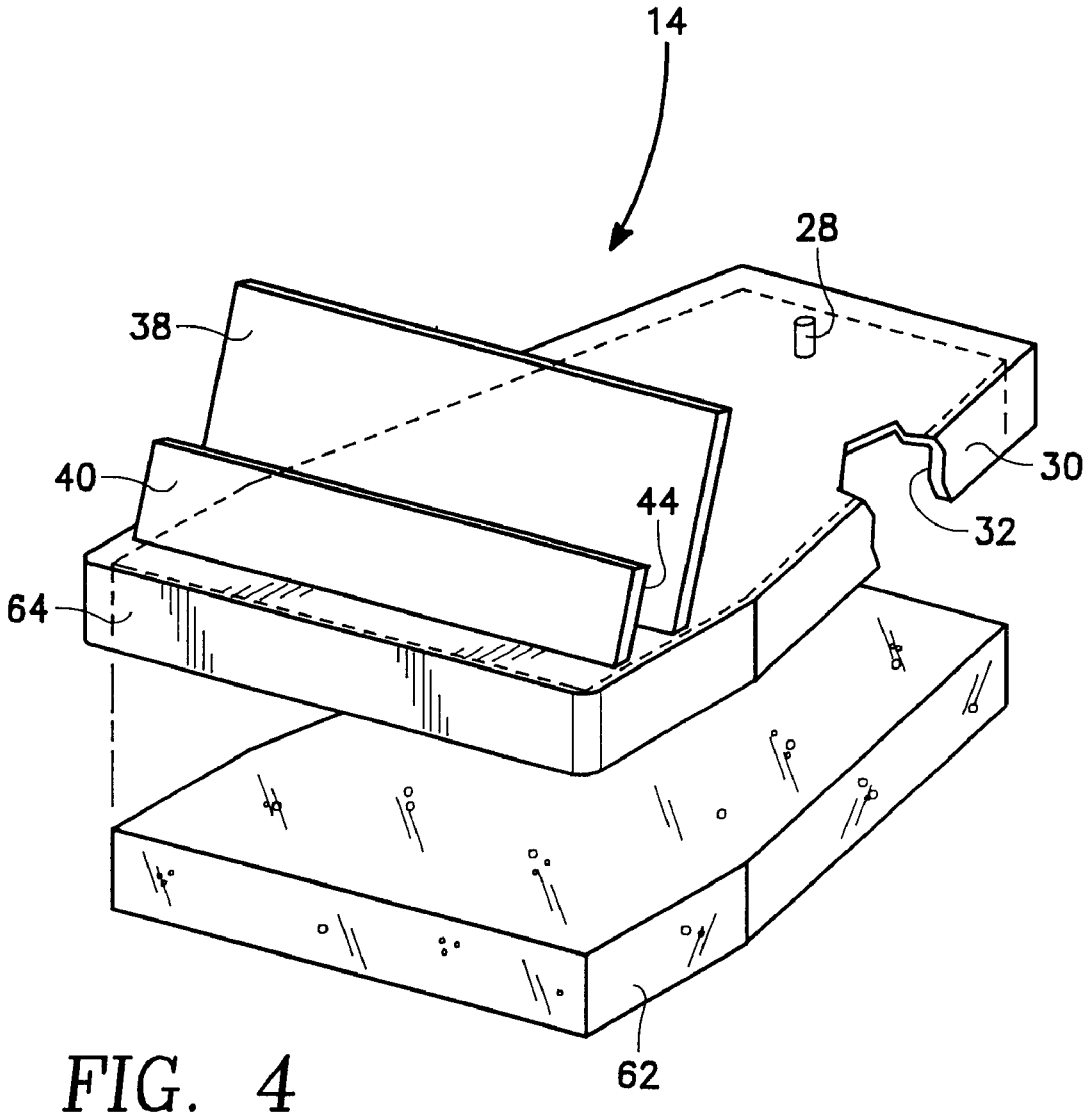
FIG. 4 is an exploded isometric view of a portion of the pontoon assembly showing its relation to a foam block that is to be usable to increase the amount of flotation of the pontoon assembly.

Referring particularly to the drawings, there is shown the ball rebound wall apparatus 10 of this invention which is composed of a ballast 12, a pontoon assembled 14 and a ball rebound panel 16. The ballast 12 can take any of numerous forms. One desirable form would be a container which has an internal chamber (not shown) which is to be filled with water (not shown), and closed by plug 18. The ballast 12 includes a pair of handles 20 and 22. Tied to handle 20 is tie rope 24. Secured to handle 22 is a tie rope 26. Tie rope 24 is attached to pin 28 mounted on the upper surface of pontoon member 30. The bottom surface of the pontoon member 30 includes an enlarged recess 32. Recess 32 is totally enclosed by a sidewall which constitutes pontoon member 30. Recess 32 is open to the bottom surface of the pontoon member 30. The tie rope 26 is fixedly secured to pin 34 which is fixedly mounted on the upper surface of a pontoon member 36. Pontoon member 36 is identical in construction to pontoon member 30 and will also include an enlarged recess formed within its undersurface, which is not shown. Each of the pontoon members 30 and 36 will be constructed of a material that is capable of floating on water. Generally, a typical material would be a light weight plastic or possibly even some type of plastic foam.

Mounted on the upper surface of the pontoon member 30 are a pair of upright members 38 and 40. The upright members 38 and 40 are planar and are located parallel to each other and are inclined at about fifteen to twenty degrees relative to vertical in a direction toward the rear edge 42 of the pontoon member 30. In between the upright members 38 and 40 is formed an open-ended groove 44.

The pontoon member 36 also has mounted on the upper surface thereof a pair of spaced-apart upright members 46 and 48. Formed between the upright members 46 and 48 is a longitudinal open ended groove 50. The panel 16 is to rest within the grooves 44 and 50. The panel 16 assumes an inclined position (fifteen to twenty degrees) in order to propel the rebounded ball in an upward direction away from the surface of the water 56. The pontoon members 30 and 36 could be located in a side-by-side abutting relationship, as is shown in the drawings, or the pontoon members 30 and 36 could be actually located spaced some distance apart. The spacing between the pontoon members 30 and 36 is to be determined by the length of the panel 16. The longer the panel 16, the further the spacing between the pontoon members 30 and 36. Generally, the pontoon member 30 will be located directly adjacent the right edge 52 of the panel 16 with the pontoon member 36 being located directly adjacent the left edge 54 of the panel 64. The back surface of the panel 16 is to rest against the upright members 38 and 46. The width of the grooves 44 and 50 is to be just slightly greater than the width of the panel 16. The upright members 40 and 48 function to prevent movement of the panel 16 in a forward direction toward the water 56 located within the swimming pool 58. Directly adjacent the swimming pool 58 and surrounding the swimming pool 58 is the swimming pool decking 60. The ballast 12 is to be placed on the decking 60. Since members 38 and 46 encounter a greater weight of the panel 16 as opposed to members 40 and 48, members 38 and 48 are larger in size than members 40 and 48 to provide a bigger support area. Members 40 and 48 are the same size and members 30 and 46 are the same size.

Figure 5:
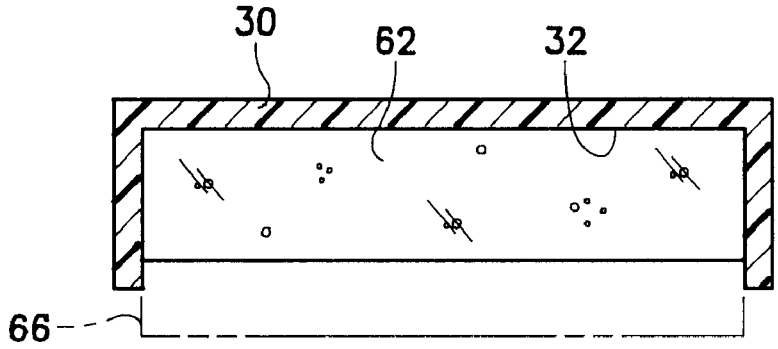
FIG. 5 is a cross-sectional view taken along line 4—4 of FIG. 2 showing the use of a float block to be inserted in conjunction with the pontoon assembly.

It is desirable to have the surface of the water 56 to be located directly adjacent the upper surface of each of the pontoon members 30 and 36. It is possible that the flotation characteristics of the pontoon members 30 and 36 is insufficient for this to occur because the panel 16 is of too heavy a weight. In order to increase the flotation characteristics of the pontoon members 30 and 36, the user can insert a foam block 62 within the enlarged recess 32. The thickness of this foam block 62 can be increased or decreased by utilizing of blocks of greater or lesser thickness thereby increasing the flotation or decreasing the flotation. Block 62 can be of greater thickness as is indicated by the dotted lines 66 in FIG. 5. The thickness of the foam block 62 is to be selected so that the surface of the water will again be located very near the upper surface of the pontoon members 30 and 36. It is to be understood that the foam block 62 is to be merely inserted within the enlarged recess 32 and can be very easily removed therefrom and replaced when such is desired.

It is considered to be within the scope of this invention that the thickness of the foam block 62 can be varied along its longitudinal length. Possibly, the portion of the block 62 that is located directly adjacent the front edge 64 of the pontoon member 30 could be thicker than the portion of the foam block 62 that is located directly adjacent the rear edge 42. The reason for this would be to raise slightly out of the water 56 the front portion of the apparatus 10 in order to rebound balls at a higher angle.

It is to be understood that the apparatus 10 of this invention can be readily installed in conjunction with the swimming pool 58 and can actually be readily removed from the swimming pool 58. In order to remove the apparatus 10 from the swimming pool 58, the ties 24 and 26 only need to be disconnected, the panel 16, removed in conjunction with the pontoon members 30 and 36 and the pontoon members 30 and 36 removed from the water 56. In order to install the apparatus 10 in conjunction with the swimming pool, only the reverse procedure needs to be put in place.

What is claimed is:

1. A ball rebound wall apparatus for a swimming pool comprising:

a pontoon assembly to be placed within a swimming pool, said pontoon assembly having an upper surface and a bottom surface, said bottom surface adapted to be submerged in the swimming pool, said upper surface having panel mounting means;

a ball rebound panel supported on said pontoon assembly and being located in conjunction with said mounting means;

ballast means adapted to be located on the swimming pool decking, said ballast means being tied to said pontoon assembly, said ballast means functioning to maintain said pontoon assembly in a set position within the swimming pool; and said bottom surface including an enlarged recess which is totally enclosed by a sidewall but open to said bottom surface.

2. A ball rebound wall apparatus for a swimming pool comprising:

a pontoon assembly to be placed within a swimming pool, said pontoon assembly having an upper surface and a bottom surface, said bottom surface adapted to be submerged in the swimming pool, said upper surface having panel mounting means;

a ball rebound panel supported on said pontoon assembly and being located in conjunction with said mounting means;

ballast means adapted to be located on the swimming pool decking, said ballast means being tied to said pontoon assembly, said ballast means functioning to maintain said pontoon assembly in a set position within the swimming pool;

said bottom surface including an enlarged recess; and float means to be located within said enlarged recess.

3. The ball rebound wall apparatus as defined in claim 2 wherein:

said float means comprising a foam block, there being available a plurality of different sizes of said foam blocks in order to be able to adjust the amount of flotation of said pontoon assembly within the swimming pool according to which size of said foam block is located within said recess as the greater the physical size of said foam block the greater the flotation.

4. A ball rebound wall apparatus for a swimming pool comprising:

a pontoon assembly to be placed within a swimming pool, said pontoon assembly having an upper surface and a bottom surface, said bottom surface adapted to be submerged in the swimming pool, said upper surface having panel mounting means;

a ball rebound panel supported on said pontoon assembly and being located in conjunction with said mounting means;

ballast means adapted to be located on the swimming pool decking, said ballast means being tied to said pontoon assembly, said ballast means functioning to maintain said pontoon assembly in a set position within the swimming pool; and said panel mounting means comprising an elongated lineal groove formed between a pair of upright spaced apart members.

5. The ball rebound wall apparatus as defined in claim 4 wherein:

said upright spaced apart members being of different sizes.

6. The ball rebound wall apparatus as defined in claim 5 wherein:

said groove being open ended.

7. The ball rebound wall apparatus as defined in claim 6 wherein:

said lower surface including an enlarged recess.

8. The ball rebound wall apparatus as defined in claim 7 wherein:

float means to be located within said enlarged recess.

9. The ball rebound wall apparatus as defined in claim 8 wherein:

said float means comprising a foam block, there being available a plurality of different sizes of said foam blocks in order to be able to adjust the amount of flotation of said pontoon assembly within the swimming pool according to which size of said foam block is located within said recess as the greater the physical size of said foam block the greater the flotation.

10. The ball rebound wall apparatus as defined in claim 9 wherein:

said pontoon assembly comprising a pair of spaced apart pontoon elements which are located in juxtaposition.

* * * * *